US007234259B2

(12) United States Patent
Lee et al.

(10) Patent No.: US 7,234,259 B2
(45) Date of Patent: Jun. 26, 2007

(54) THREE-DIMENSIONAL ALBUM PAGE PROTECTOR

(76) Inventors: Anna Jee Lee, 1826-11th Ave., San Francisco, CA (US) 94122; Stephen D. Morey, 218 Railroad Ave., Woodacre, CA (US) 94973

( * ) Notice: Subject to any disclaimer, the term of this patent is extended or adjusted under 35 U.S.C. 154(b) by 174 days.

(21) Appl. No.: 10/756,154

(22) Filed: Jan. 13, 2004

(65) Prior Publication Data

US 2004/0139643 A1 Jul. 22, 2004

(51) Int. Cl.
*A47G 1/06* (2006.01)

(52) U.S. Cl. ..... 40/771; 402/79; 206/461; 206/470

(58) Field of Classification Search ..... 40/771, 40/772, 661; 402/79; 206/461, 467, 470; 281/38; D19/32, 33
See application file for complete search history.

(56) References Cited

U.S. PATENT DOCUMENTS 1,956,527 A * 4/1934 De Groot ..... 40/776
3,940,778 A * 2/1976 Craig et al. ..... 40/776
5,017,037 A 5/1991 Sturtevant
5,186,566 A * 2/1993 Cameron ..... 402/79
5,316,404 A * 5/1994 Hensel ..... 402/79
5,350,061 A * 9/1994 Gunn ..... 206/214
5,584,387 A * 12/1996 Grant ..... 206/216
6,039,495 A 3/2000 Zimmerman et al.
6,183,158 B1 2/2001 Lynton
6,390,714 B1 5/2002 Bradley et al.
6,652,178 B2 * 11/2003 Walton ..... 402/79

OTHER PUBLICATIONS

Protect-A-Page, p. 1, Dec. 4, 2003.
C-line Products, Inc.—Memory Book, www.c-lineproducts.com/MemoryBook.html.

* cited by examiner

*Primary Examiner*—Gary C. Hoge
(74) *Attorney, Agent, or Firm*—Chandler & Udall, LLP; Dale F. Regelman

(57) ABSTRACT

A three-dimensional page protector comprising a pocket defining a partially-enclosed space, where that pocket comprises a first length, a first width, a height, and a first side. The three-dimensional page protector further includes a longitudinal edge continuously attached to the first side of the pocket, where that longitudinal edge has the first length and a second width, where the first width is greater than said second width, and where the longitudinal edge is formed to include one or more through-bores.

19 Claims, 11 Drawing Sheets

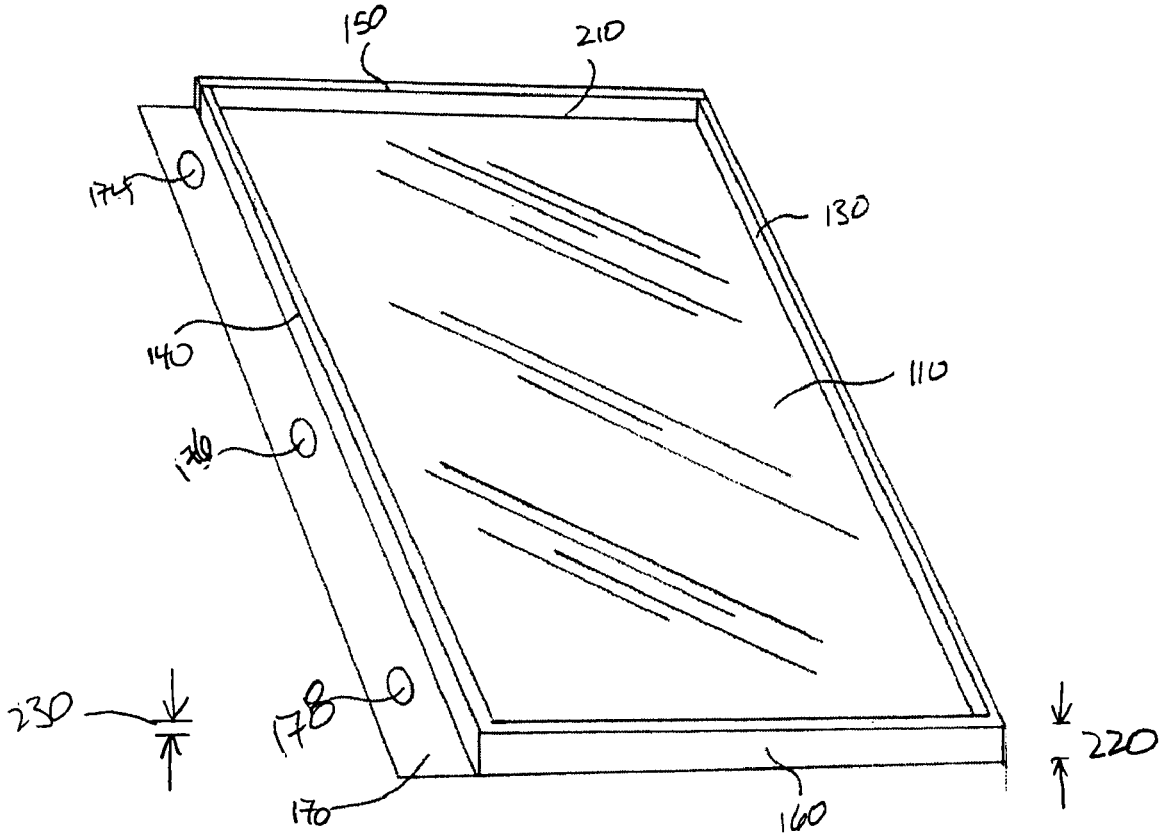
FIGURE 2
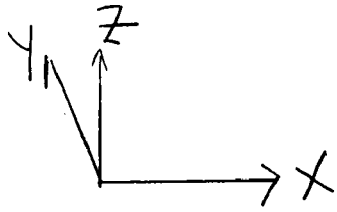

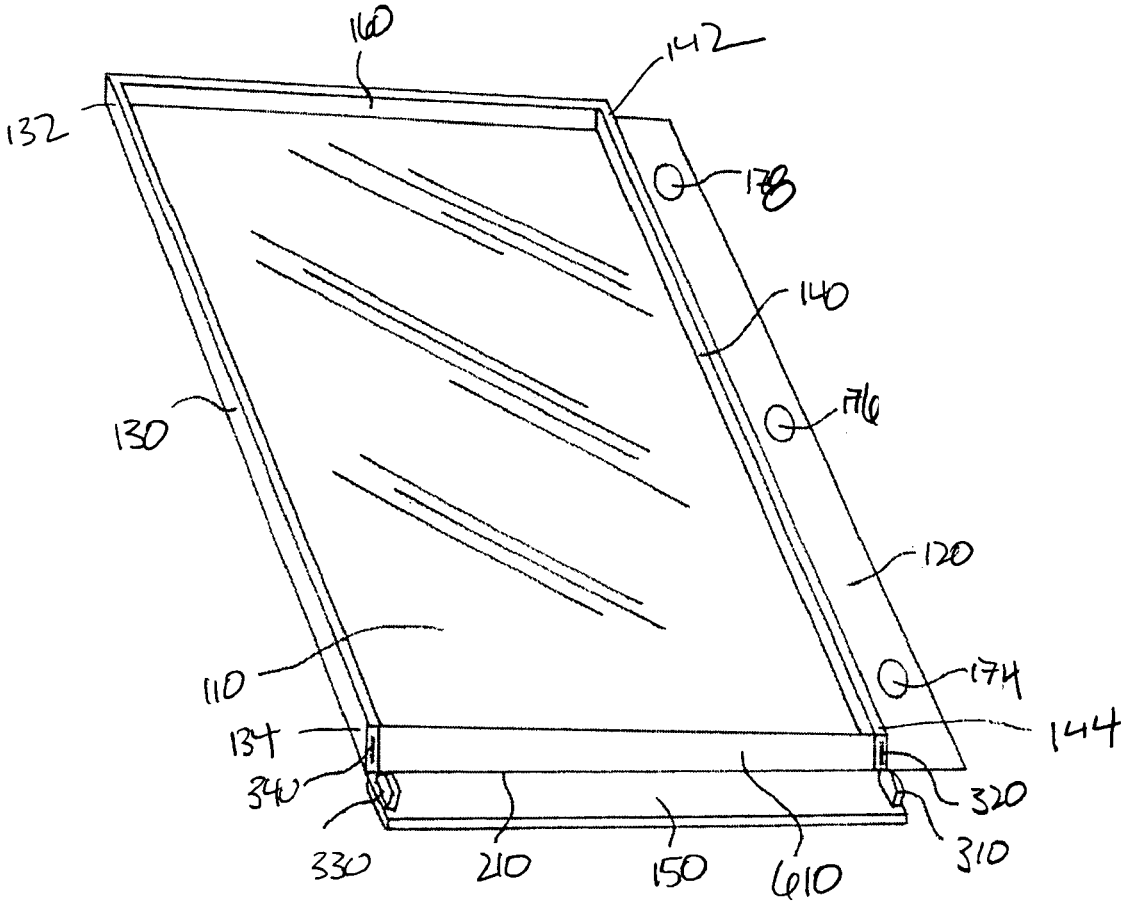
FIGURE 3
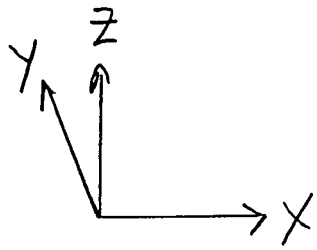

THREE-DIMENSIONAL ALBUM PAGE PROTECTOR

FIELD OF THE INVENTION

The invention relates to a three-dimensional album page protector.

BACKGROUND OF THE INVENTION

Prior art methods to protect documents, artwork, and the like, comprise using what are commonly referred to as "protector sleeves" for those documents. Such prior art "protector sleeves" adequately protect two-dimensional objects, such as for example documents, cards, photographs, and the like. Many, in fact most, prior art "protector sleeves" are not suitable, however, for protecting three-dimensional objects.

Certain prior art protector sleeves are formed such that the enclosed pocket is large enough to physically accommodate objects having dimensions along each of the three axis, i.e. where the height of the object exceeds about a tenth of an inch. Placing a three dimensional object within such a prior art protector sleeve forms what is sometimes referred to as a "lumpy" page. Such a "lumpy" page often assumes a pillow configuration.

While such prior art protector sleeves may be dimensioned to enclose three dimensional objects, the resulting "lumpy" pages do not include rigid side walls to minimize and/or eliminate compressive forces being exerted on the enclosed object(s). In order to protect such "lumpy" pages, an album housing a plurality of sheets including one or more lumpy sheets must not be stored, handled, or transported, horizontally whereby the combined weight of the plurality of pages will crush the three dimensional objects. Rather, such albums must only be stored, handled, and/or transported, vertically. Needless to say, such prior art protector sleeves provide less than maximal protection for three dimensional objects.

What is needed is a three-dimensional album page protector which is formed such that three-dimensional objects can be removeably disposed therein, and wherein those three-dimensional objects are protected from being crushed by the weight of other album pages disposed there above. Applicants' three-dimensional album page protector provides such an improvement over the prior art.

SUMMARY OF THE INVENTION

Applicants' invention includes a three-dimensional page protector. Applicants' three-dimensional page protector includes a pocket defining a partially-enclosed space, where that pocket comprises a first length, a first width, a height, and a first side. Applicants' three-dimensional page protector further includes a longitudinal edge portion continuously attached to the first side of the pocket, where that longitudinal edge has the first length and a second width, where the first width is greater than said second width, and where the longitudinal edge is formed to include one or more through-bores.

BRIEF DESCRIPTION OF THE DRAWINGS

The invention will be better understood from a reading of the following detailed description taken in conjunction with the drawings in which like reference designators are used to designate like elements, and in which:

FIG. 2 is a left perspective view of FIG. 1;

FIG. 3 is an end perspective view of FIG. 2;

DETAILED DESCRIPTION OF THE PREFERRED EMBODIMENTS

Figure 1:
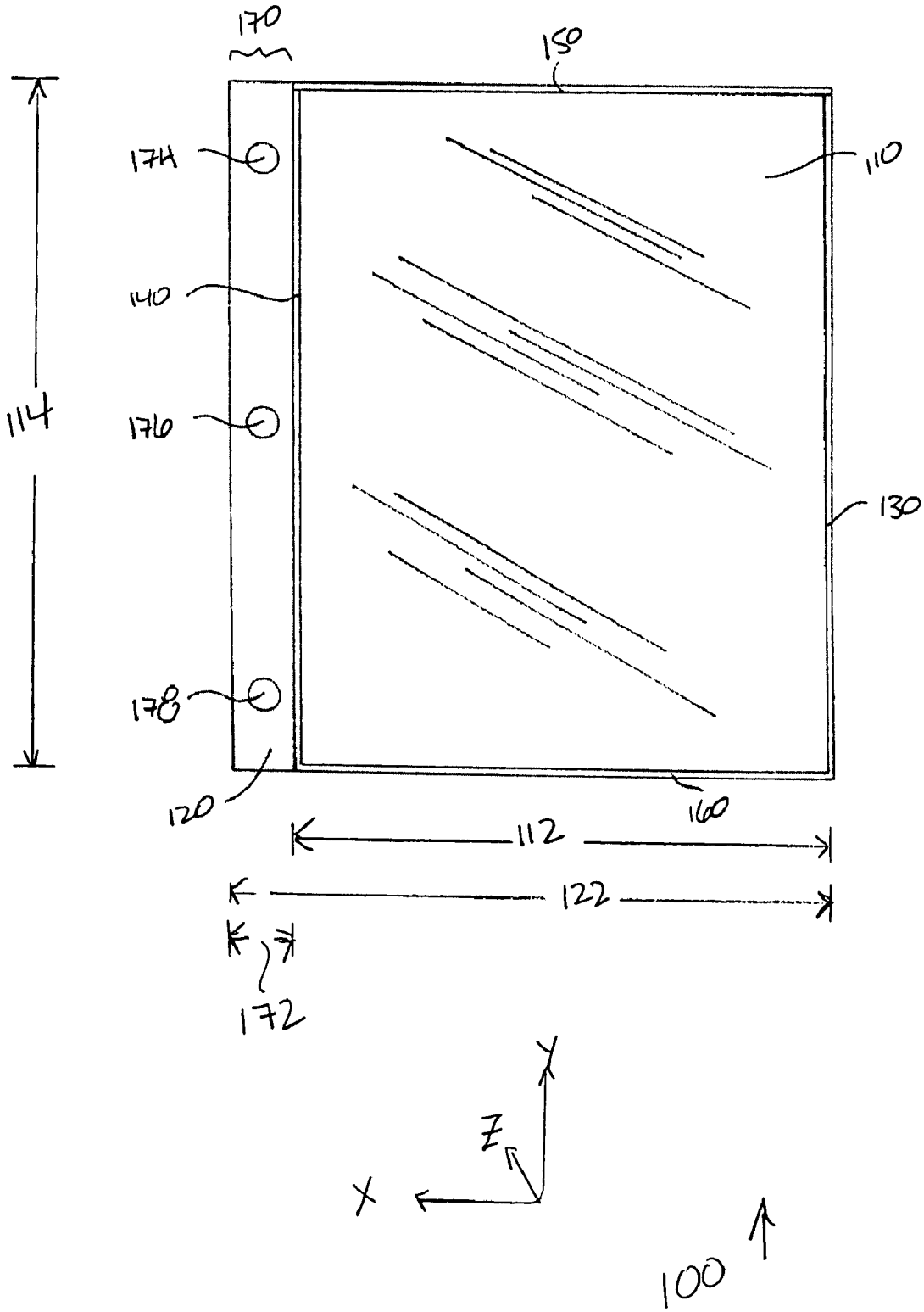
FIG. 1 is a front elevational view of the three-dimensional album page protector constructed in accordance with the invention.

Referring to the illustrations, like numerals correspond to like parts depicted in the Figures. Referring now to FIG. 1, Applicants' three-dimensional album page protector 100 includes a first planar sheet 110 and a second planar sheet 120, each being generally rectangular in shape. Planar sheet 110 comprises a first dimension 114 along the Y axis, and a second dimension 112 along the X axis.

In certain embodiments, first dimension 114 is between about 4 inches and about 24 inches. In certain embodiments, first dimension 114 is between about 6 inches and about 11 inches. In certain embodiments, first dimension 114 is about 11 inches.

In certain embodiments, second dimension 112 is between about 4 inches and about 24 inches. In certain embodiments, second dimension 112 is between about 6 inches and about 11 inches. In certain embodiments, second dimension 112 is about 8.5 inches.

Planar sheet 120 comprises a first dimension 114 along the Y axis, and a second dimension 122 along the X axis. As a general matter, dimension 122 is greater than dimension 112. In certain embodiments, second dimension 122 is between about 5 inches and about 13 inches. In certain embodiments, second dimension 122 is about 9 inches.

First planar sheet 110 is optically clear. In certain embodiments, first planar sheet 110 is formed from polycarbonate, polystyrene, polyvinylchloride, polyethylene, polypropylene, combinations thereof, and the like. In certain embodiments, second planar sheet 120 is optically clear. In other embodiments, second planar sheet 120 is not optically clear. In certain embodiments, second planar sheet 120 is formed from polycarbonate, polystyrene, polyvinylchloride, polyethylene, polypropylene, combinations thereof, and the like.

In certain embodiments, first planar sheet 110 and second planar sheet 120 are formed from a flexible material. By "flexible material," Applicants mean a material having a tensile strength of about 4,000 psi or less measured using ASTM Method D638, and/or a hardness of about 50–100 Shore A measured using ASTM Method D785.

In certain embodiments, first planar sheet 110 and second planar sheet 120 are formed from a rigid material. By "rigid material," Applicants mean a material having a tensile strength greater than about 6,000 psi measured using ASTM Method D638, and/or a hardness greater than about 65–85 Shore D measured using ASTM Method D785.

Referring now to FIGS. 1 and 2, first planar sheet 110 is separated from second planar sheet 120 by three side walls 130, 140, and 160. Side walls 130, 140, and 160, are formed from rigid materials comprising wood, metal, plastic and combinations thereof. In certain embodiments, walls 130, 140, and/or 160, are formed of polypropylene. In certain embodiments, walls 130, 140, and/or 160, are formed of polystyrene. In certain embodiments, walls 130, 140, and/or 160, are formed of polyurethane. In certain embodiments, walls 130, 140, and/or 160, are formed from a full-density polymeric material. In certain embodiments, walls 130, 140, and/or 160, are formed from a structural foam material.

Walls 130 and 140 have dimension 114 along the Y axis. Wall 160 has dimension 112 along the X axis. Side walls 130, 140, and 160, are formed from a rigid material having a dimension 220 along the Z axis, and width 230. In certain embodiments, dimension 220 is between about 1/10 inch and about 2 inches. In certain embodiments, dimension 220 is between about ¼ inch and about 1 inch. In certain embodiments, dimension 220 is about ⅜ inches. In certain embodiments, width 230 is between about 1/10 inches and about ¼ inches. In certain embodiments, width 230 is about ⅛ inch.

In certain embodiments, walls 130, 140, and 160, are integrally formed with second planar sheet 120. In these embodiments, walls 130, 140, and 160, are formed from an optically clear material. In these embodiments, the integral second planar sheet 120, wall 130, wall 140, and wall 160, are affixed to first planar sheet 110 using conventional attachment methods, including for example heat sealing, sonic welding, plastic welding, use of one or more adhesives, and the like.

In certain embodiments, walls, 130, 140, and 160, are integrally formed with first planar sheet 110. In these embodiments, walls 130, 140, and 160, are formed from an optically clear material. In these embodiments, the integral first planar sheet 110, wall 130, wall 140, and wall 160 are affixed to second planar sheet 120 using conventional attachment methods, including for example heat sealing, sonic welding, plastic welding, use of one or more adhesives, and the like.

In certain embodiments, walls 130, 140, and 160, are each separately formed, and subsequently attached to one another and to first planar sheet 110 and second planar sheet 120 using conventional attachment methods, including for example heat sealing, sonic welding, plastic welding, use of one or more adhesives, and the like. In these embodiments, walls 130, 140, and 160, may be formed from an optically clear material, an optically opaque material, and combinations thereof.

Figure 14:
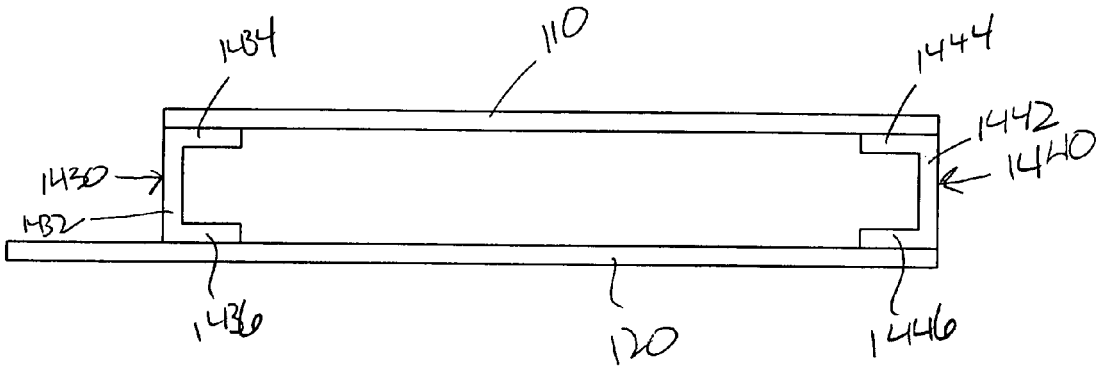
FIG. 14 is a cross-sectional view on a rigid wall portion having a U-shaped cross-section.

In certain embodiments the side wall portions of Applicants' three dimensional page protector comprise "U"-shaped structures. Referring now to FIG. 14, side wall 1430 includes first member 1432 and second member 1434 attached to one end of first member 1432 and extending outwardly therefrom and third member 1436 attached to the opposite end of first member 1432 and extending outwardly therefrom. Member 1432 in combination with member 1434 and member 1436 forms a U-shaped structure as shown in FIG. 14.

Similarly, side wall 1440 includes first member 1442 and second member 1444 attached to one end of first member 1442 and extending outwardly therefrom and third member 1446 attached to the opposite end of first member 1442 and extending outwardly therefrom. Member 1442 in combination with member 1444 and member 1446 forms a U-shaped structure as shown in FIG. 14.

Figure 15:
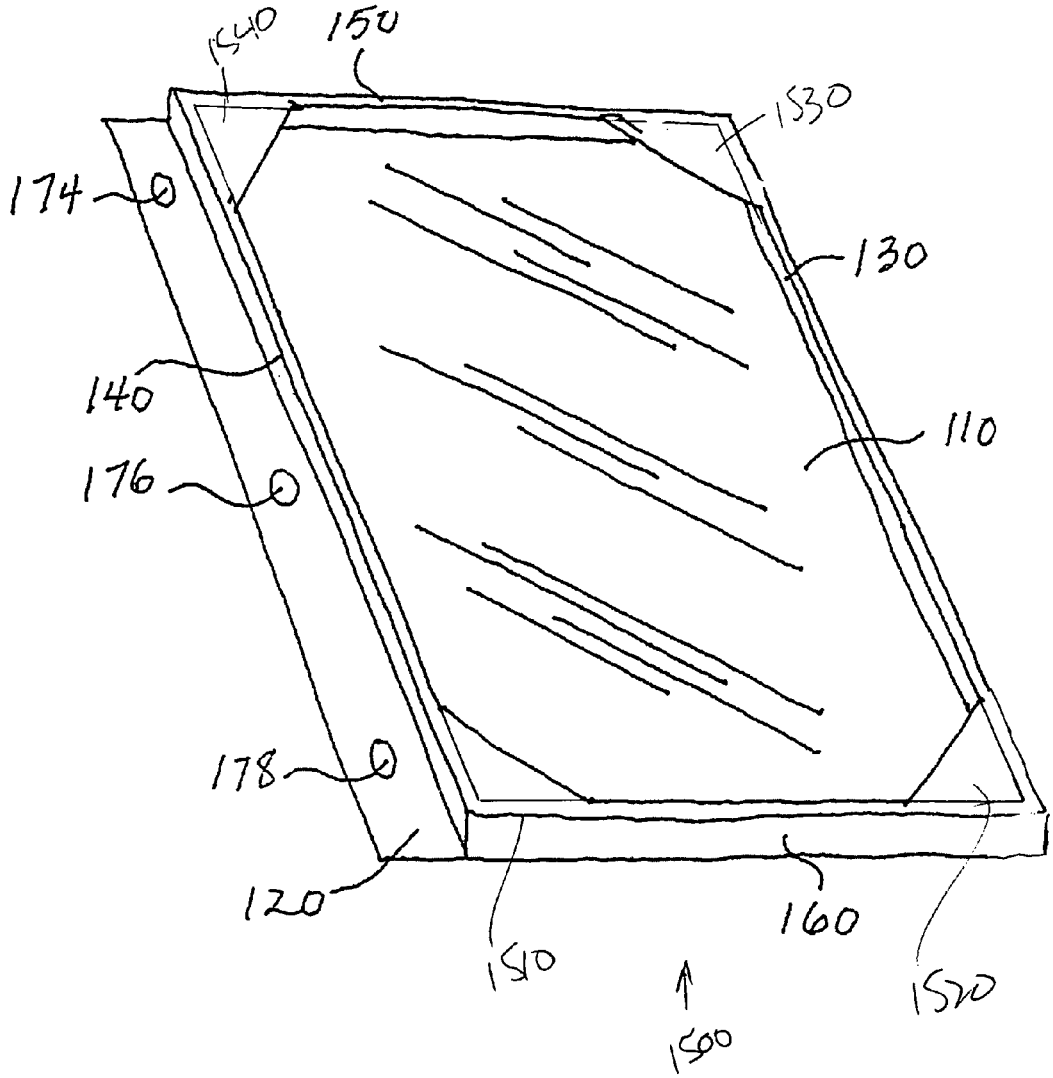
FIG. 15 is a perspective view of an embodiment of Applicants' three-dimensional album page protector which include corner reinforcing structures.

Referring now to FIG. 15, embodiment 1500 of Applicants' invention includes corner reinforcing structures 1510, 1520, 1530, and 1540. Triangular reinforcing structure 1510 is disposed between walls 140 and 160 adjacent first planar sheet 110. Triangular reinforcing structure 1520 is disposed between walls 130 and 160 adjacent first planar sheet 110. Triangular reinforcing structure 1530 is disposed between wall 130 and door assembly 150 when closed, and adjacent first planar sheet 110. Triangular reinforcing structure 1540 is disposed between wall 140 and door assembly 150 when closed, and adjacent first planar sheet 110. In the illustrated embodiment of FIG. 15, reinforcement structures 1510/1520/1530/1540 each are triangular shape. In other embodiments, reinforcement structures 1510/1520/1530/1540 have shapes selected from the group of square, rectangle, pentagon, hexagon and irregular shapes.

Reinforcing structures 1510, 1520, 1530, and 1540, are formed from one or more rigid materials. In certain embodiments, walls 130, 140, 160, and reinforcing structures 1510, 1520, 1530, and 1540, are integrally formed.

Regardless of the method of formation/attachment of the various components, the subcombination comprising first planar sheet 110, second planar sheet 120, first wall, 130, second wall 140, and third wall 160, comprises a pocket defining a partially-enclosed space.

Regardless of the method of formation/attachment, when first planar sheet is attached to one edge of walls 130, 140, and 160, respectively, and second planar sheet is attached to the opposing edge of walls 130, 140, and 160, respectively, longitudinal edge 170 of second planar sheet 120 remains exposed. Longitudinal edge 170 has dimension 114 along the Y axis, and dimension 172 along the X axis. In certain embodiments, dimension 172 is between about ¼ inch and about 2 inches. In certain embodiments, dimension 172 is about ½ inch.

In the illustrated embodiments of FIGS. 1 and 2, Applicants' three-dimensional album page protector includes three walls and a door assembly, i.e. has a rectangular shape in the X/Y plane. In other embodiments, Applicants' three-dimensional album page protector includes four walls and a door assembly, i.e. has a pentagonal shape in the X/Y plane. In other embodiments, Applicants' three-dimensional album page protector includes five walls and a door assembly, i.e.

has a hexagonal shape in the X/Y plane. In other embodiments, Applicants' three-dimensional album page protector includes more than four walls in combination with a door assembly.

In the illustrated embodiments of FIGS. 1 and 2, longitudinal edge 170 includes three through-bores disposed therethrough, namely through-bores 174, 176, and 178. In other embodiments, longitudinal edge includes no through-bores. In other embodiments, longitudinal edge includes fewer than three through-bores. In other embodiments, longitudinal edge includes more than three through-bores.

In the illustrated embodiment of FIG. 2, album page protector 100 includes movable door assembly 150. In certain embodiments, door assembly 150 is not permanently attached to one or more side walls or to either planar sheet 110 or 120. In other embodiments, door assembly 150 is attached to second planar sheet 120 by hinge 210.

Door assembly 150 is formed from one or more rigid materials selected from the group consisting of wood, metal, plastic, and combinations thereof. In certain embodiments, door assembly 150 is formed of polyvinylchloride. In certain embodiments, door assembly 150 is formed of polyethylene. In certain embodiments, door assembly 150 is formed of polypropylene. In certain embodiments, door assembly 150 is formed of polystyrene. In certain embodiments, door assembly 150 is formed of polyurethane. In certain embodiments, door assembly 150 is formed from a full-density polymeric material. In certain embodiments, door assembly 150 is formed from a structural foam material.

In certain embodiments, hinge 210 is separately formed, and subsequently attached to second planar sheet 120 and door assembly 150. In certain embodiments, hinge 210 is formed from metal, wood, plastic, and combinations thereof. In certain embodiments, hinge 210 is integrally formed with second planar sheet 120 and door assembly 150.

FIGS. 1 and 2 show door assembly 150 in a first, i.e. closed position, wherein hinge 210 is interconnected to second planar sheet 120. In other embodiments, hinge 210 is interconnected to first planar sheet 110 rather than to second planar sheet 120. In either embodiment, door assembly 150 can be releaseably closed to form an enclosed space.

FIG. 3 is a top end perspective view of FIG. 2 showing door 150 in a second, i.e. open, position. Referring now to FIG. 3, door assembly 150 includes a closure mechanism to secure door 150 in the closed position of FIGS. 1 and 2. In the illustrated embodiment of FIG. 3, that closure mechanism includes member 310 and member 330, where member 310 can be removeably inserted into slot 320 and where member 330 can be removeably inserted into slot 340 when door assembly 150 is rotated around hinge 210. In the illustrated embodiment of FIG. 3, first end 132 of wall 130 is attached to a first end of wall 160, and first end 142 of wall 140 is attached to the opposing second end of wall 160. Second end 134 of wall 130 includes slot 340. Second end 144 of wall 140 includes slot 320.

In certain embodiments, planar sheets 110/120 are formed from one or more flexible materials, and walls 130/140/160 and door assembly 150 are formed from one or more rigid materials. Referring again to FIG. 2, in these embodiments Applicants' three-dimensional album page protector is flexible in the X/Y planes defined by planar sheets 110 and 120, while being rigid in the X/Z and Y/Z planes defined by walls 130/140/160 and door 150. This combination of flexible top and bottom portions and rigid side walls/door allows the storage of one or more three-dimensional objects of varying dimensions within Applicants' three-dimensional album page protector while protecting those enclosed objects from being crushed.

In certain embodiments, Applicants' three-dimensional album page protector is virtually indestructible. In these embodiments, planar sheets 110/120, and walls 130/140/160, and door assembly 150, are formed from a rigid material, such as polycarbonate, having a notched Izod impact strength of 14 ft-lb/in (750 J/m) or greater measure using ASTM Method D256.

Figure 6A:
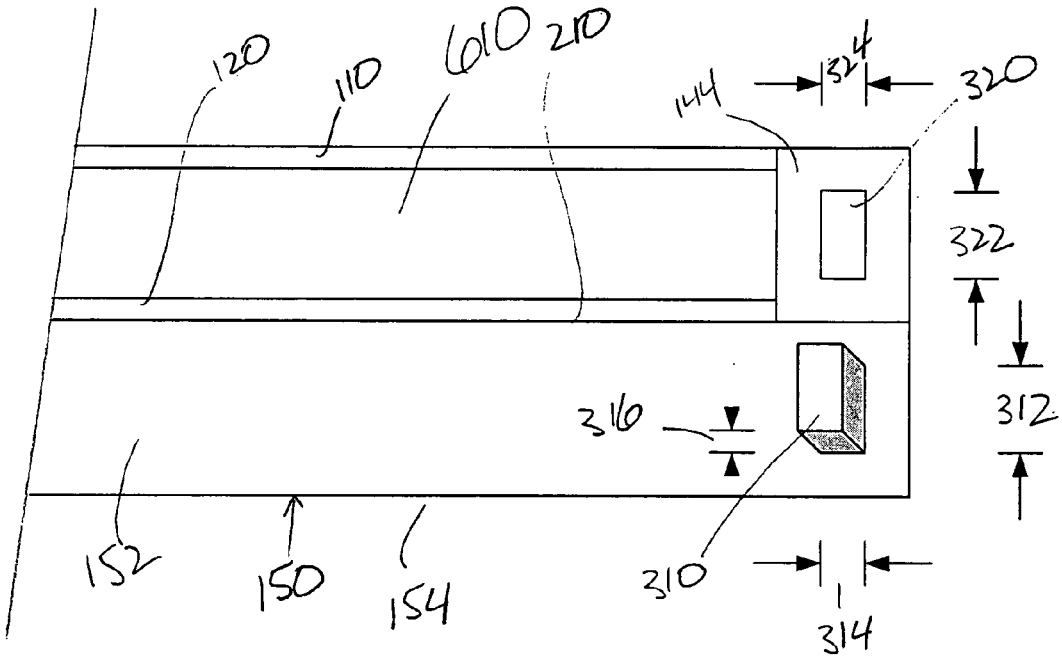
FIG. 6A is a view of Applicants' three-dimensional album page protector showing a hinged door assembly and a first securing mechanism.
Figure 6A:
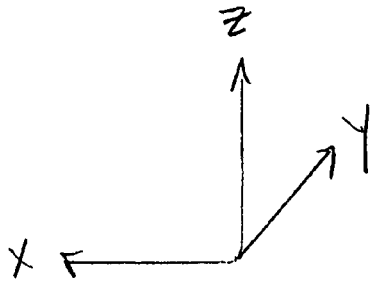

Referring now to FIGS. 3 and 6A, end 144 of wall 140 is formed to include aperture 320 which extends inwardly into wall 140. Aperture 320 has a first dimension 322 along the Z axis, a second dimension 324 along the X axis. Door assembly 150 includes a first surface 152 and an opposing second surface 154. When door assembly 150 is disposed in the closed configuration, surface 152 is in contact with end portion 144.

In the illustrated embodiment of FIG. 6A, member 310 is disposed on surface 152 such that member 310 can be removeably inserted into aperture 320 when door assembly 150 is rotated upwardly around integral hinge 210. Member 310 has a first dimension 312 along the Z axis of FIG. 6, a second dimension 314 along the X axis of FIG. 6, and a third dimension 316 along the Y axis of FIG. 6. Dimension 312 is substantially equal to dimension 322. Dimension 314 is substantially equal to dimension 324. By "substantially equal," Applicants mean the same plus or minus about 10 percent. Aperture 320 extends into end 144 a distance greater than dimension 316.

When door 150 is disposed in the first, closed position, shown in FIGS. 1 and 2, first planar sheet 110, second planar sheet 120, first wall 130, second wall 140, third wall 160, and door 150, define a totally-enclosed space. When door 150 is disposed in the second, open position, shown in FIGS. 3, 6A, 6B, and 6C, first planar sheet 110, second planar sheet 120, first wall 130, second wall 140, third wall 160, and door 150, define a partially-enclosed space having open end 610. That open end 610 allows access to the internal space defined by first planar sheet 110, second planar sheet 120, and walls 130, 140, and 160.

In the illustrated embodiment of FIG. 3, Applicants' album page protector 100 includes two securing members, namely members 310 and 330, and two corresponding securing apertures, namely apertures 320 and 340, respectively. In these embodiments, member 330 and aperture 340 are formed as described above with reference to member 310 and aperture 320. In other embodiments, Applicants' album page protector 100 includes one securing member and one corresponding securing aperture.

Figure 6B:
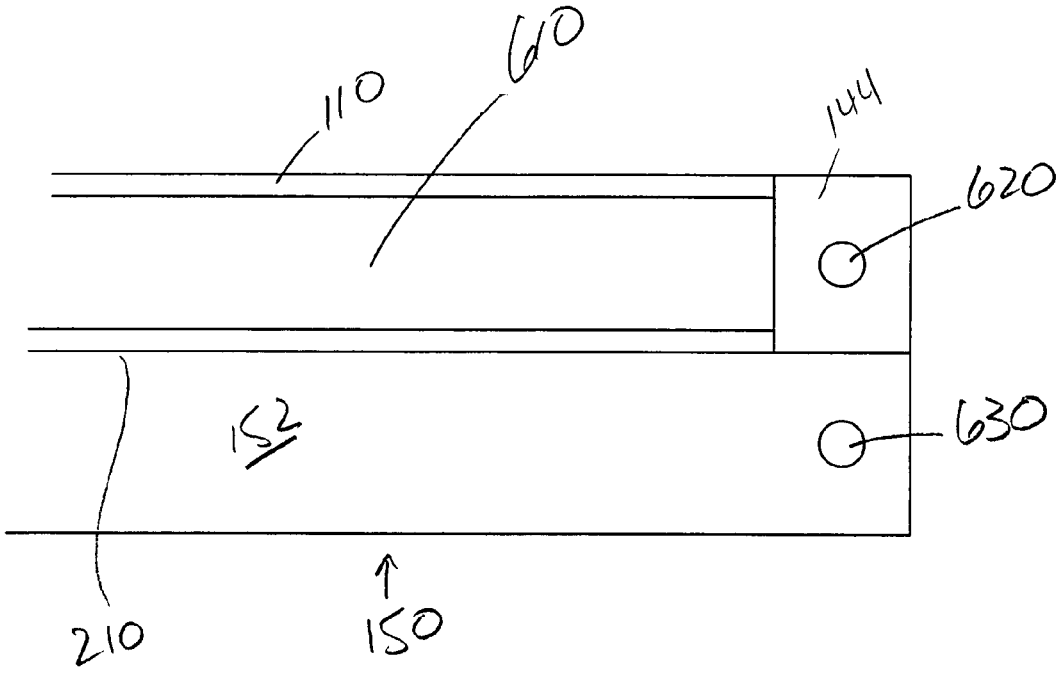
FIG. 6B is a view of Applicants' three-dimensional album page protector showing a hinged door assembly and a second securing mechanism.

Referring now to FIG. 6B, in certain embodiments, one or more first magnets 620 are disposed on end 144 of wall 140 and one or more second magnets 630 are disposed on surface 152 (FIG. 6) of door assembly 150 such that when door assembly is moved into the closed position, the one or more first magnets are magnetically attracted to the one or more second magnets thereby releaseably securing door assembly in the closed orientation shown in FIGS. 1 and 2. In the illustrated embodiment of FIG. 6B, first magnet 620 and second magnet 630 each have a circular cross-section. In other embodiments, first magnet 620 and/or second magnet 630 have shapes selected from the group of a rectangular cross-section, a square cross-section, and an irregular cross-section.

Figure 6C:
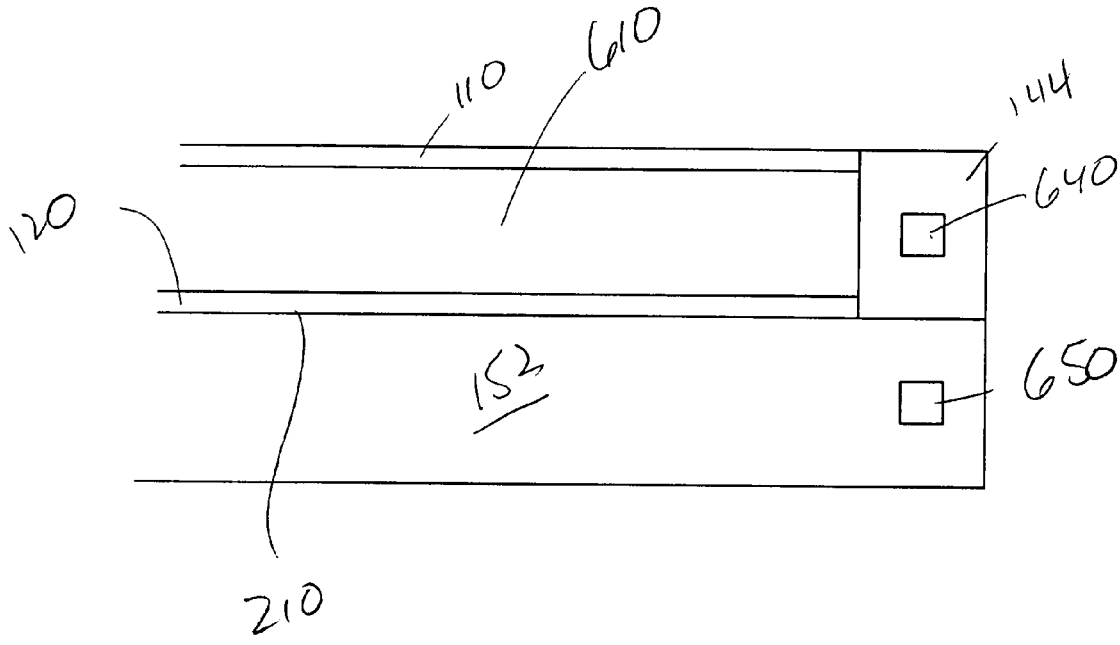
FIG. 6C is a view of Applicants' three-dimensional album page protector showing a hinged door assembly and a third securing assembly.

In certain embodiments, door assembly can be releaseably secured in the closed position of FIGS. 1 and 2 using hook and loop fasteners. Referring now to FIG. 6C, in certain embodiments, one or more hook elements 640 are disposed on end 144 of wall 140 and one or more loop elements 650 are disposed on surface 152 (FIG. 6) of door assembly 150 such that when door assembly is moved into the closed position, the hook elements intermesh with the loop elements thereby releaseably securing door assembly in the closed orientation shown in FIGS. 1 and 2. In the illustrated embodiment of FIG. 6C, first hook element 640 and second hook element 650 each have a square cross-section. In other embodiments, first hook element 640 and/or second hook element 650 have shapes selected from the group of a rectangular cross-section, a round cross-section, and an irregular cross-section.

In certain embodiments, door assembly can be releaseably secured in the closed position of FIGS. 1 and 2 using a combination of insertable members as shown in FIG. 6A, and one or more magnets as shown in FIG. 6B, and/or a combination of hook and loop fasteners as shown in FIG. 6C. In certain embodiments, door assembly can be releaseably secured in the closed position of FIGS. 1 and 2 using a combination which includes one or more of insertable members, one or more magnets, hook and loop fasteners, double-sided tape, one or more pressure-sensitive adhesives, and the like.

Figure 4:
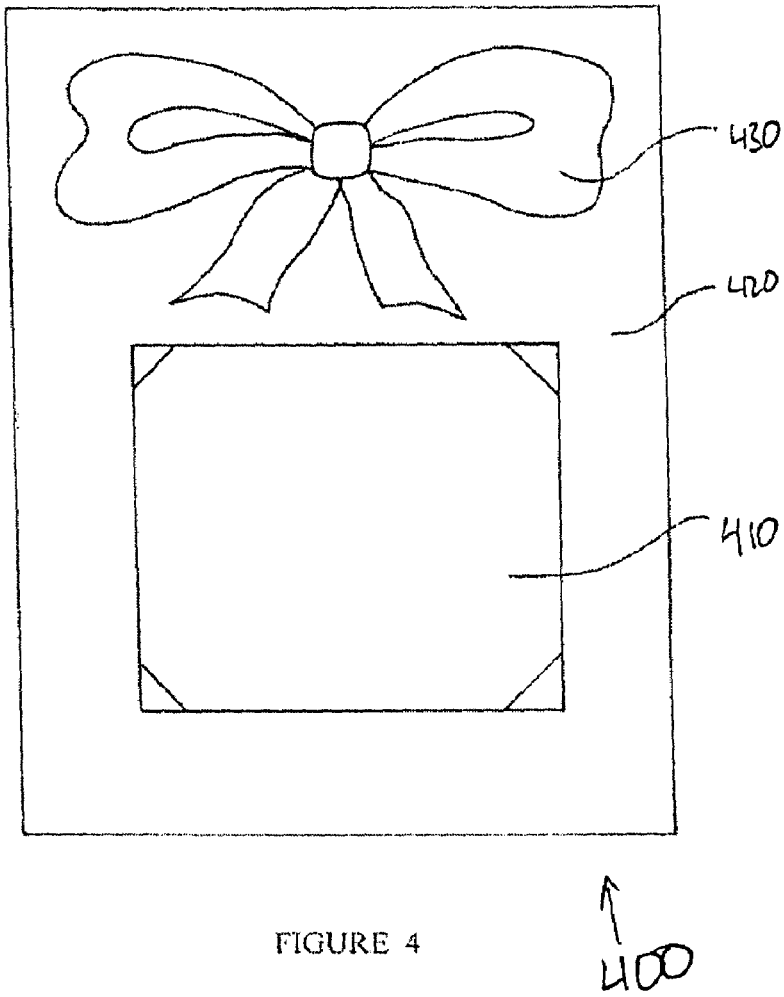
FIG. 4 is a front elevational view of a three-dimensional object that can be removeably inserted into Applicants' three-dimensional album page protector.

FIG. 4 is a front elevational view of assembly 400 which includes first feature 410 disposed on a planar sheet 420. First feature 410 may comprise, for example, a photograph or other substantially 2-dimensional artwork. Assembly 400 further includes additional ornamental features, such as for example a 3-dimensional bow 430. Features 410 and 430 may be two-dimensional or three-dimensional. Planar sheet 420 is dimensioned such that planar sheet 420 can be removeably disposed in Applicants' album page protector, i.e. can be removeably inserted into open end 610.

Features 410 and 430 can be placed anywhere on the sheet 420. The illustrated embodiment of FIG. 4 shows assembly 400 comprises two ornamental features, namely features 410 and 430, disposed on sheet 420. In other embodiments, assembly 400 includes fewer than 2 ornamental features. In other embodiments, assembly 400 includes more than 2 ornamental features.

Figure 5:
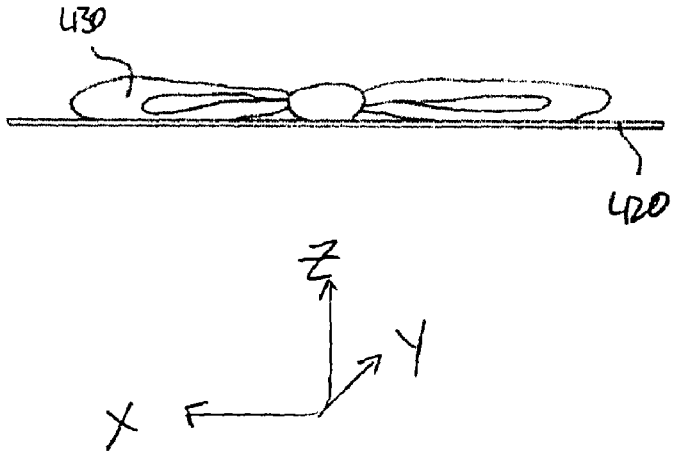
FIG. 5 is a side view of FIG. 4 showing the dimensionality of the 3-dimensional object of FIG. 4.

FIG. 5 is a side view of FIG. 4 showing the dimensionality of the feature 430. When assembly 400 is disposed in Applicants' page protector 100, and when a plurality of page protectors 100 are stacked one atop another in, for example an album, 3-dimensional object 430 is protected from being crushed by the weight of one or more pages disposed thereabove.

As those skilled in the art will appreciate, sheet 420 with three-dimensional object(s) attached thereto, where those objects may be created by the user, is inserted into the three-dimensional album page protector and will thus be protected and preserved from being compressed when it is in a closed album. Rigid sidewalls 130, 140, and 160, preserve the sheet with three-dimensional object(s) attached FIG. 4 in its original, intended appearance.

Sheet 420 may comprise any material suitable for mounting, such as paper, cardstock, plastic, board, etc. Objects attached to the sheet 420 could include, for example planar and three-dimensional objects, art, scrape book material, photographs, pictures, prints, memorabilia, keepsakes, mementos and embellishments. The user may place on the sheet 420 any combination of objects as will be appreciated in the piece for display in the album. Sheet 420, as well as the height of the three-dimensional object 430, should be sized to fit into the receiving pocket 310 of Applicants' three-dimensional album page protector 100.

To access open end 610, the user opens door 150 by rotating door assembly 150 away from first planar sheet 110. Once members 310 and 330 are released from the apertures 320 and 340, respectively, door 150 will rotate around hinge 210. Thereafter, the desired display assembly 400 is inserted into open end 610, and door 150 again closed. Door 150 can be re-secured by rotating assembly 150 around hinge 210 and pushing members 310 and 330 into the apertures 320 and 340, respectively. As those skilled in the art will appreciate, assembly 400 comprising one or more three-dimensional object(s) attached thereto can be removed from the three-dimensional album page protector and re-inserted as many times as necessary.

Assembly 400 comprising one or more three-dimensional object(s) attached thereto can be placed into Applicants' three-dimensional album page protector to be displayed facing toward first planar sheet 110, or facing toward the second planar sheet 120. A user could dispose two sheets with three-dimensional object(s) attached thereto in page protector 100, wherein a first display sheet faces toward first planar sheet 110 and wherein the second display sheet faces toward second planar sheet 120.

One or more of Applicants' three-dimensional album page protector can be removeably disposed into an album. Engaging the through-bores 174, 176, and 178 with the retaining members of the binding system of the album will secure the one or more three-dimensional album page protectors into the album. Such binding systems include but are not limited to a loose-leaf binder, a ring binder, a post-hinge, or a strap-hinge album.

One or more of Applicants' three-dimensional album page protectors can be included in a bound book. In these embodiments, those one or more three-dimensional album page protectors need not include through-bores 174, 176, and 178.

Figure 7:
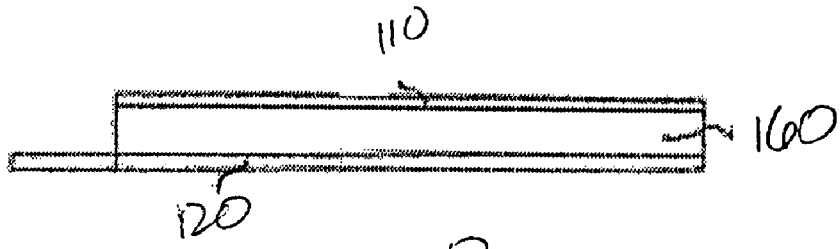
FIG. 7 is side view of Applicants' three-dimensional album page protector.

FIG. 7 shows a side view of Applicants' album page protector without additional ornamentation. In certain embodiments, the various elements of Applicants' album page protector 100 (FIG. 1) include one or more ornamental features. Such ornamentation comprises, for example, disposing two-dimensional art work on first planar sheet 110, and/or on second planar sheet 120, and/or on one or more wall portions; foil stamping the first planar sheet, and/or the second planar sheet, and/or one or more wall portions; and/or embossing the first planar sheet, and/or the second planar sheet, and/or one or more wall portions.

Figure 8:
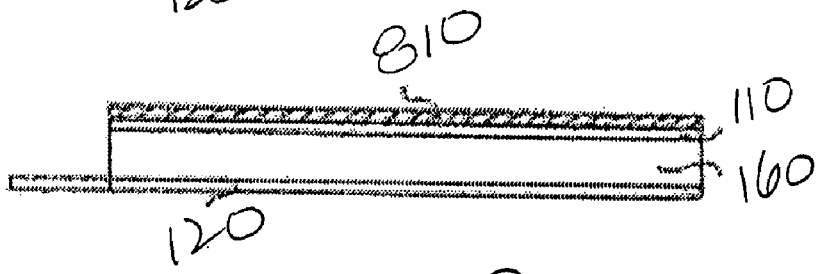
FIG. 8 is a side view of Applicants' three-dimensional album page protector with the first planar sheet being printed or hot foil stamped.
Figure 9:
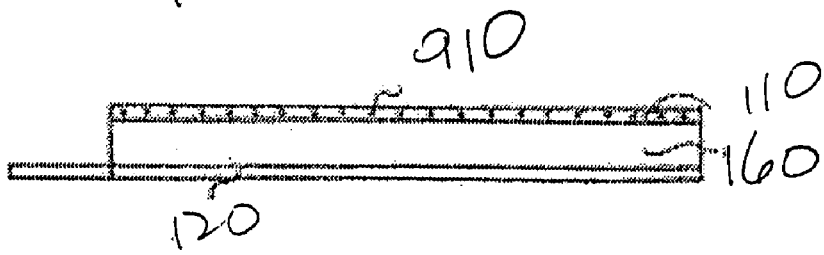
FIG. 9 is a side is a side view of Applicants' three-dimensional album page protector with embedded objects added to the first planar sheet.
Figure 10:
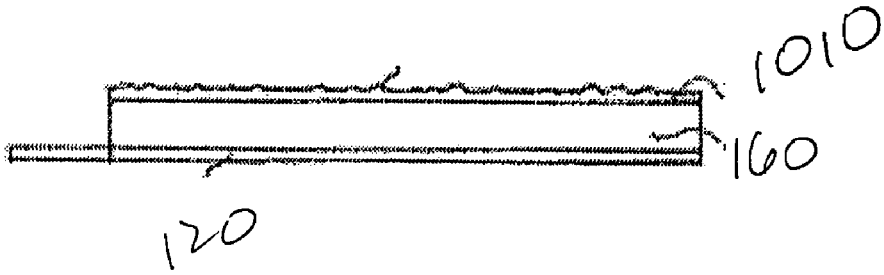
FIG. 10 is a side view of Applicants' three-dimensional album page protector with the first planar sheet being embossed with a design.

For example, FIG. 8 shows two dimensional artwork 810 disposed on the top surface of first planar sheet 110. FIG. 9 shows a plurality of embedded objects 910 disposed in first planar sheet 110. In certain embodiments, this plurality of embedded objects includes glitter, Mylar bits, metallic flakes, and the like. FIG. 10 shows design feature 1010 embossed on first planar sheet 110.

Figure 11:
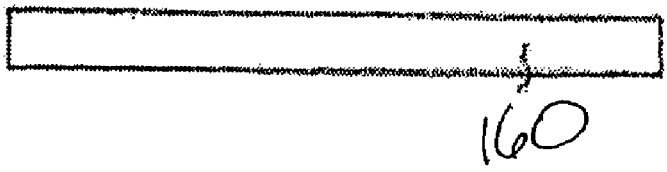
FIG. 11 is an elevational view of the outer side of a non-ornamented wall portion of Applicants' album page protector.
Figure 12:
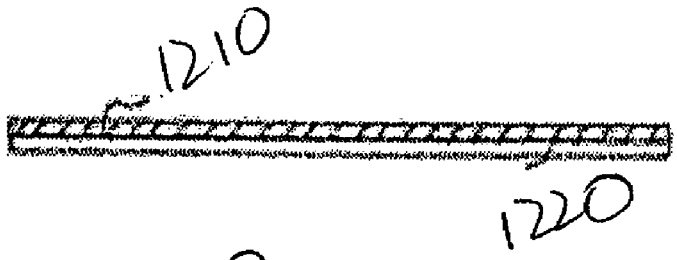
FIG. 12 is a side view of Applicants' three-dimensional album page protector with printing or hot foil stamping disposed on one or more wall portions.
Figure 13:
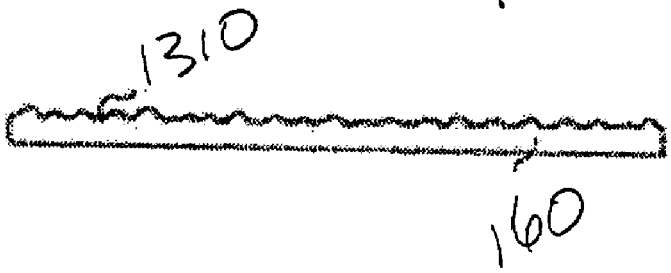
FIG. 13 is a side view of Applicants' three-dimensional album page protector with a design molded into one or more wall portions.

FIG. 11 shows an elevational view of the outer surface of a wall/door portion, such as for example wall 130 (FIG. 1), and/or wall 140 (FIG. 1), and/or wall 160 (FIG. 1), and/or door assembly 150 (FIG. 1), where that wall/door element includes no ornamentation. FIG. 12 shows the outer surface of a wall portion, such as for example wall 130 (FIG. 1), and/or wall 140 (FIG. 1), and/or wall 160 (FIG. 1), and/or door assembly 150 (FIG. 1), with printing or hot foil stamping disposed on wall/door portion 1210 but not on wall/door portion 1220. FIG. 13 shows the outer surface of a wall portion, such as for example wall 130 (FIG. 1), and/or wall 140 (FIG. 1), and/or wall 160 (FIG. 1), and/or door assembly 150 (FIG. 1), with a design 1310 molded into that wall portion.

While the preferred embodiments of the present invention have been illustrated in detail, it should be apparent that modifications and adaptations to those embodiments may occur to one skilled in the art without departing from the scope of the present invention as set forth in the following claims.

We claim:

1. A three-dimensional page protector, comprising;

a pocket defining a partially-enclosed space, wherein said pocket includes a first length, a first width, a height, and a first side;

a longitudinal edge portion continuously attached to said first side of said pocket, wherein said longitudinal edge portion has said first length and a second width, wherein said first width is greater than said second width, and wherein said longitudinal edge portion is formed to include one or more through-bores;

wherein said pocket comprises:

a first planar sheet, wherein said first planar sheet is optically clear;

a second planar sheet, wherein said second planar sheet is optically clear;

a plurality of rigid walls, wherein each of said plurality of rigid walls has a first edge and an opposing second edge, wherein said first planar sheet is continuously attached to the first edge of each of said plurality of rigid walls, and wherein said second planar sheet is continuously attached to the second edge of each of said plurality of rigid walls, to define said pocket, wherein said pocket is formed to include an open end.

2. The three-dimensional page protector of claim 1, wherein one or more of said plurality of rigid walls has a U-shaped cross-section.

3. The three-dimensional page protector of claim 1, further comprising:

a moveable door assembly comprising a first side and an opposing second side;

a hinge interconnecting said moveable door assembly and said second planar sheet, wherein said moveable door assembly is capable of being rotated around said hinge from an open position to a closed position.

4. The three-dimensional page protector of claim 3, further comprising a closure mechanism to releaseably secure said moveable door assembly in said closed position.

5. The three-dimensional page protector of claim 4, wherein said closure mechanism comprises a plurality of magnets.

6. The three-dimensional page protector of claim 4, wherein said closure mechanism comprises a plurality of hook and loop fasteners.

7. The three-dimensional page protector of claim 3, wherein said first planar sheet comprises said first length and said first width, and wherein said second planar sheet comprises said first length and a third width, wherein said third width equals the sum of said first width and said second width.

8. The three-dimensional page protector of claim 3, wherein said plurality of rigid walls comprises three walls, further comprising:

a first wall, having a first end and a second end;

a second wall, having a first end and a second end;

a third wall, having a first end and a second end;

wherein said first end of said first wall is attached to said first end of said second wall, and wherein said first end of said third wall is attached to said second end of said second wall, to form a parallelepiped having an open end, wherein said open end is defined by one edge of said first planar sheet one edge of said second planar sheet, said second end of said first wall, and said second end of said third wall.

9. The three-dimensional page protector of claim 3, wherein said door assembly comprises a first edge and a second edge, and wherein said hinge comprises a first edge and a second edge, and wherein said first edge of said hinge is attached to said first end of said second planar sheet, and wherein said second edge of said hinge is attached to said first edge of said door assembly.

10. The three-dimensional page protector of claim 9, wherein said second planar sheet, and said door assembly, and said hinge, are integrally formed.

11. The three-dimensional page protector of claim 3, wherein said door assembly further comprises a first surface, an opposing second surface, and a first member disposed on said first surface, and wherein said second end of said first wall is formed to include a first aperture extending inwardly therein, such that when said door assembly is rotated around said hinge such that said second surface of said door assembly contacts said second end of said first wall said first member is removeably inserted into said first aperture.

12. The three-dimensional page protector of claim 11, wherein said door assembly further comprises a second member disposed on said first surface, and wherein said first end of said third wall is formed to include a second aperture extending inwardly therein, such that when said door assembly is rotated around said hinge such that said second surface of said door assembly contacts said second end of said third wall said second member is removeably inserted into said second aperture.

13. The three-dimensional page protector of claim 8, further comprising two-dimensional artwork disposed on said first planar sheet.

14. The three-dimensional page protector of claim 8, further comprising two-dimensional foil stamping disposed on said first planar sheet.

15. The three-dimensional page protector of claim 8, further comprising a plurality of embedded objects disposed in said first planar sheet.

16. The three-dimensional page protector of claim 8, further comprising embossing disposed on said first planar sheet.

17. The three-dimensional page protector of claim 8, further comprising two-dimensional artwork disposed on one or more of said three rigid walls.

18. The three-dimensional page protector of claim 8, further comprising a plurality of embedded objects disposed on one or more of said three rigid walls.

19. The three-dimensional page protector of claim 8, further comprising embossing disposed on one or more of said three rigid walls.

* * * * *